US008262282B2

(12) United States Patent
Lynn et al.

(10) Patent No.: US 8,262,282 B2
(45) Date of Patent: Sep. 11, 2012

(54) MONITORING APPARATUS

(75) Inventors: John M. Lynn, Austin, TX (US); Thomas John Blake, Round Rock, TX (US)

(73) Assignee: FloTime, LLC

( * ) Notice: Subject to any disclaimer, the term of this patent is extended or adjusted under 35 U.S.C. 154(b) by 3 days.

(21) Appl. No.: 13/068,338

(22) Filed: May 9, 2011

(65) Prior Publication Data

US 2012/0147712 A1 Jun. 14, 2012

Related U.S. Application Data

(63) Continuation-in-part of application No. 12/380,331, filed on Feb. 26, 2009, now Pat. No. 7,963,692.

(60) Provisional application No. 61/067,263, filed on Feb. 27, 2008, provisional application No. 61/124,676, filed on Apr. 18, 2008, provisional application No. 61/125,809, filed on Apr. 29, 2008, provisional application No. 61/402,071, filed on Aug. 23, 2010.

(51) Int. Cl.
*G04F 1/00* (2006.01)

(52) U.S. Cl. ..... 368/89; 368/327

(58) Field of Classification Search ..... 368/89, 368/10, 278, 93, 327
See application file for complete search history.

(56) References Cited

U.S. PATENT DOCUMENTS 1,531,217 A * 3/1925 Piatty ..... 368/93
1,807,752 A 6/1931 Poster
2,018,538 A * 10/1935 Webb ..... 73/861
2,659,433 A * 11/1953 Brown ..... 368/2
3,420,205 A 1/1969 Morison
3,783,598 A * 1/1974 Parr ..... 368/65
3,786,777 A 1/1974 Smith
3,933,337 A 1/1976 Morris et al.
3,954,011 A 5/1976 Manske
4,002,139 A 1/1977 Payne
4,028,877 A 6/1977 Vatterott
4,154,107 A 5/1979 Giezen
4,206,838 A 6/1980 Bradley
4,229,813 A 10/1980 Lilly
4,304,342 A 12/1981 Morane
4,447,161 A 5/1984 Stoll et al.
4,629,330 A 12/1986 Nichols
D307,870 S 5/1990 Irgang et al.
5,189,979 A 3/1993 Popenoe
5,343,444 A 8/1994 Agut
5,457,665 A 10/1995 Reid
(Continued)

OTHER PUBLICATIONS

Pump—Dictionary.com; Jun. 22, 2012.*

*Primary Examiner* — Sean Kayes
(74) *Attorney, Agent, or Firm* — The Law Firm of H. Dale Langley, Jr. P.C.

(57) ABSTRACT

A timing apparatus on a container cap which is associated with a standard push pump. The timer is activated by pushing down on the standard pump that then moves a fluid that is held within a chamber having a first compartment and a second compartment. The compartments are in fluid communication with each other. The fluid is moved from one compartment to the other compartment when the pump is pushed and the timer works because the fluid returns to the first compartment over some known range of time when the pump is no longer being pushed.

7 Claims, 7 Drawing Sheets

U.S. PATENT DOCUMENTS

| | | | | |
|---|---|---|---|---|
| 5,602,804 | A | 2/1997 | Haas | |
| 5,630,531 | A | 5/1997 | Gaucher | |
| 5,667,303 | A | 9/1997 | Arens | |
| 5,822,280 | A | 10/1998 | Haas | |
| 5,915,576 | A | 6/1999 | Robinson | |
| 5,930,206 | A | 7/1999 | Haas | |
| 5,958,525 | A | 9/1999 | Green et al. | |
| 6,021,924 | A | 2/2000 | Suck et al. | |
| 6,236,624 | B1 | 5/2001 | Kriesel et al. | |
| 6,373,786 | B1 | 4/2002 | Kagan | |
| 6,682,521 | B2 | 1/2004 | Petrakis | |
| 6,741,523 | B1 | 5/2004 | Bommarito et al. | |
| 7,018,847 | B2 | 3/2006 | Unger et al. | |
| 7,280,441 | B2 | 10/2007 | MacDonald et al. | |
| 7,388,814 | B2 | 6/2008 | Teffenhart | |
| 7,505,372 | B2 * | 3/2009 | Borg | 368/65 |
| 7,616,528 | B2 * | 11/2009 | Meadows | 368/76 |
| 2004/0013048 | A1 | 1/2004 | Adamy | |
| 2007/0195652 | A1 | 8/2007 | Ambrozy et al. | |
| 2009/0211642 | A1 | 8/2009 | Lynn | |

* cited by examiner

MONITORING APPARATUS

CROSS-REFERENCE TO RELATED APPLICATION

This Application for Patent is a Continuation-in-Part of utility patent application having Ser. No. 12/380,331 filed Feb. 26, 2009 now U.S. Pat. No. 7,963,692 and entitled "Monitoring Apparatus" and further claims priority to Provisional Patent Application No. 61/067,263 filed Feb. 27, 2008, entitled "Method and Apparatus for Determining the Prior Usage of a Medical Container"; Provisional Patent Application No. 61/124,676 filed Apr. 18, 2008, entitled "Timing Apparatus"; Provisional Patent Application No. 61/125,809 filed Apr. 29, 2008, entitled "Timing Apparatus"; and Provisional Patent Application 61/402,071 filed Aug. 23, 2010 entitled "Monitoring Apparatus", the disclosures of which are each expressly incorporated herein by reference.

TECHNICAL FIELD

This invention relates to determining a recent usage history for various items, such as medical containers, liquid soap bottles, conditioner bottles and toothpaste tubes via an indicator. In particular, the indicator can change its appearance over a period of time.

BACKGROUND

Certain monitoring apparatuses are known in the art. One current art method is to have a multiple compartment pill container for daily pills taken on a regular basis. The pill container lists each day of the week on seven compartments, for example, and at the start of each week a user fills the container with the pills for week. This method works well for users having a daily routine with pills meant to be taken once a day. But it is not always helpful for pills intended to be taken more than once a day. The multiple compartment pill container also does not work well for users who do not have a daily routine or for users who are taking pills for a particular illness for a short period of time. Such intermittent users of medicine are not likely to have a weekly container. Even if the intermittent users do have such a weekly container, they are not in the habit of using the container and the container may go unused.

Accordingly, in addition to the standard weekly pharmaceutical container method, other known reminder and timing methods and devices exist. These prior art devices and methods typically rely on complicated mechanical devices or electronic devices. These complicated devices are normally designed to let a user know when the pill bottle was opened last. Since most pill bottles are small, these complicated prior art devices are unwieldy, weigh too much, are too expensive, and can be difficult to use.

The monitoring apparatus described herein can be used in a large number of different contexts and associated with many different apparatuses. One important example of a potential use of the monitoring apparatus described herein concerns the importance of taking medication or vitamins when they are supposed to be taken. Some studies show that 10% of hospital visits are caused by patients not taking their medications as instructed.

This failure to take medication as instructed often occurs because the user simply can't remember whether or not they have taken their medicine. This forgetfulness can result in either (1) a failure to take a pill on time because the person believes they have already done so, or (2) taking an additional pill (i.e. over medication) because they have forgotten that they have previously taken one. Either scenario can be dangerous or at very least not optimum from a dosage standpoint.

Other uses of the monitoring apparatus described herein include any context in which a user would like to know if they or someone else has recently performed some task (e.g. opening a container). The monitoring apparatus described herein is especially desirable when the person doesn't need to know exactly when they last performed some act (i.e. electronic exactness in time keeping is not necessary). Examples include a timer on sun tan lotion to alert a user to reapply after an amount of time has passed, a timer on a liquid soap bottle, a timer on a toothbrush, a timer on a container of toothpaste, (e.g. toothpaste tube), household cleaners with a time component related to their use, parents monitoring their children's use of items such as a TV remote, determining when a container of milk was last opened (e.g. how long has it been out of the refrigerator), monitoring whether a user's pet has been fed via a timer on the pet's food bowl, and so forth.

What is needed is a simple, small, and cost effective apparatus and method to inform a user of a medical container, toothpaste tube or some other apparatus or container when the user last opened or used the apparatus or container or performed some act.

SUMMARY OF THE INVENTION

The techniques described herein provide a monitoring apparatus is disclosed for monitoring time by a color change indicator, comprising an observable fluid, a first reservoir holding at least a portion of the observable fluid, and a second reservoir abutting the first reservoir. The first reservoir is responsive to pressure on it such that a portion of the observable fluid flows into the second reservoir. The second reservoir is responsive to a lack of pressure in the first reservoir such that a portion of the observable fluid in the second reservoir reverses flow back into the first reservoir once the first reservoir is not under pressure.

In one embodiment, a method of monitoring time by a color change indicator comprises containing observable fluid in a first reservoir abutting a second reservoir, applying pressure to the fluid in the first reservoir, forcing at least a portion of the observable fluid from the first reservoir into the second reservoir, and observing the change in appearance of the indicator as the observable fluid reverses flow back into the first reservoir over a predetermined range of time. As described below, other features and variations can be implemented, if desired, and a related method can be utilized, as well.

DESCRIPTION OF THE DRAWINGS

It is noted that the appended drawings illustrate only exemplary embodiments of the invention and are, therefore, not to be considered limiting of its scope, for the invention may admit to other equally effective embodiments.

DETAILED DESCRIPTION

Figure 3:
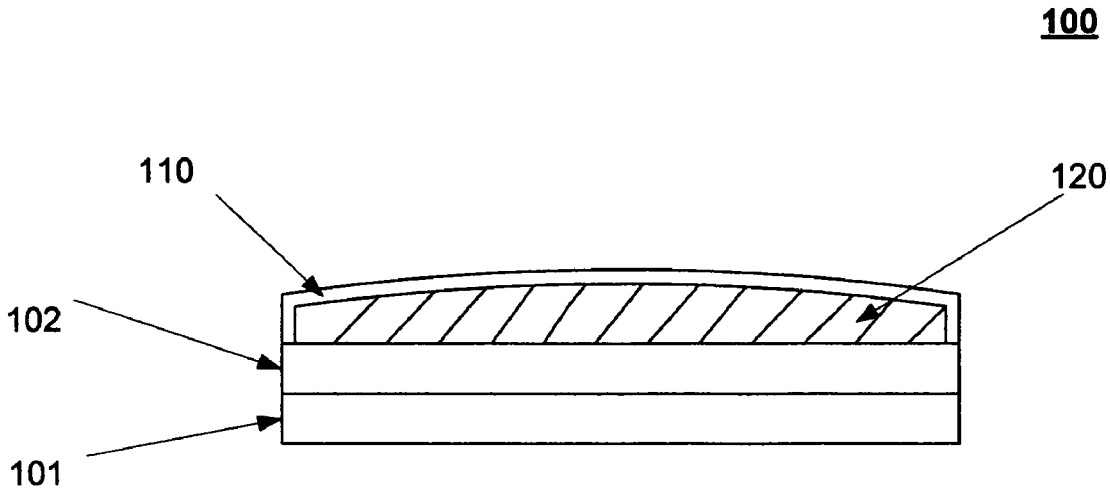
FIG. 3 is a side view of a monitoring apparatus having a flexible membrane and an observable fluid.
Figure 4:
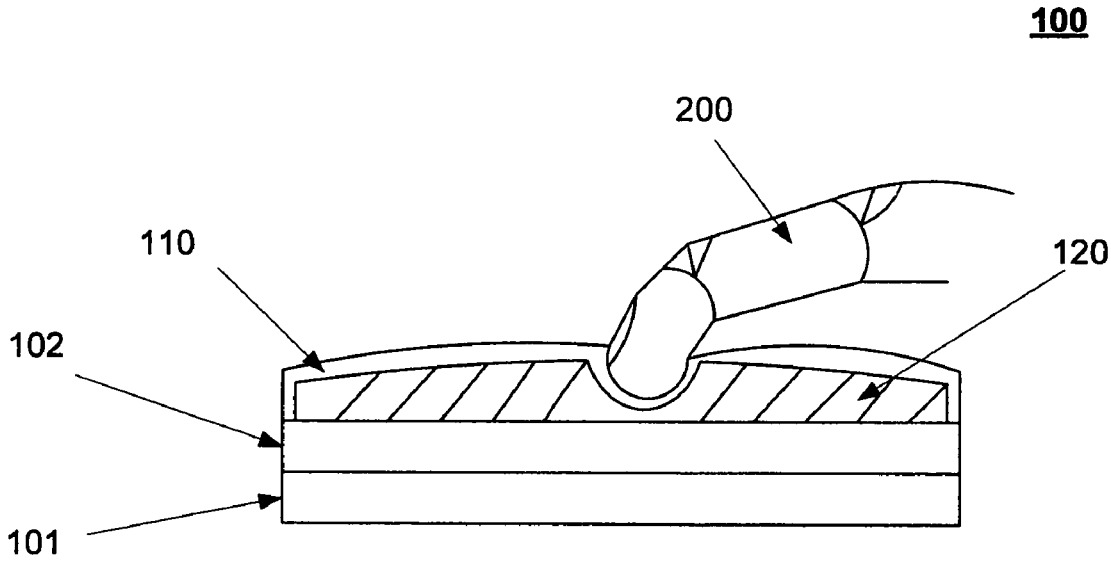
FIG. 4 is a side view of the monitoring apparatus of FIG. 3 having pressure applied to force the fluid from a first reservoir into a second reservoir.
Figure 5:
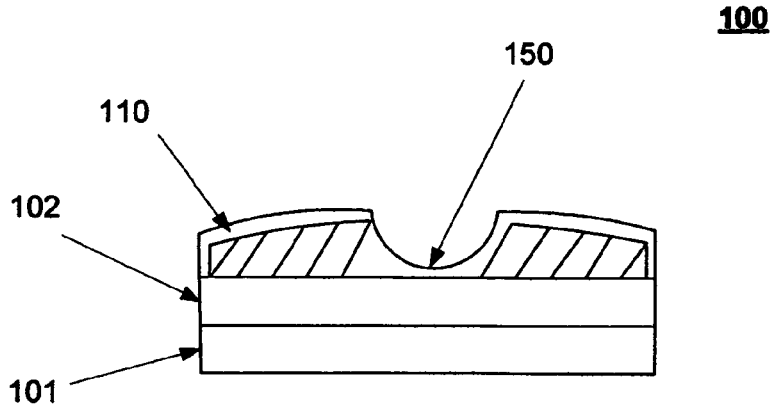
FIG. 5 is a side view of the monitoring apparatus after the fluid has been forced from the first reservoir (i.e., the portion of the indicator under the membrane where the pressure was applied) and before the fluid has returned to the first reservoir and the membrane has returned to its original shape.

The techniques described herein provide a monitoring apparatus for monitoring time by a color change indicator, comprising an observable fluid, a first reservoir holding at least a portion of the observable fluid, and a second reservoir abutting the first reservoir. The first reservoir is responsive to pressure on it such that a portion of the observable fluid flows into the second reservoir. The second reservoir is responsive to a lack of pressure in the first reservoir such that a portion of the observable fluid in the second reservoir reverses flow back into the first reservoir once the first reservoir is not under pressure. In some embodiments, even under normal conditions, the second reservoir can also contain the observable fluid, for example, as shown in FIGS. 3-5 described below.

Figure 1:
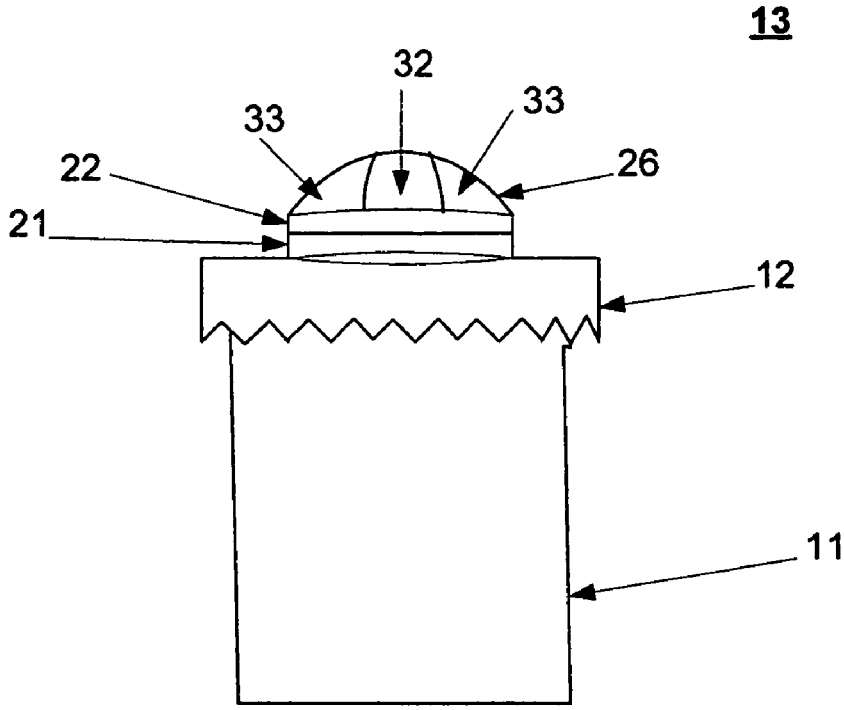
FIG. 1 is a cross section view of a monitoring apparatus having a color change indicator positioned on a cap of a pharmaceutical container.

FIG. 1 shows a standard pharmaceutical container 11 with standard removable cap 12. In FIG. 1, monitoring apparatus 13 is shown on top of cap 12, but it may be placed elsewhere on either pharmaceutical container 11 or cap 12. The key is that it is easy and convenient for a user of pharmaceutical container 11 to activate monitoring apparatus 13. It should also preferably be placed prominently in such a way that it is difficult to forget to activate it. It may also be desirous to place it so that it is impossible to open pharmaceutical container 11 without activating monitoring apparatus 13. This may involve placing it on the side of cap 12 in an area where it is necessary to put pressure on cap 12 in order to bypass the child protective locks on the medical container. This would assure that monitoring apparatus 13 is activated each time pharmaceutical container 11 is opened. If it is desirous to keep monitoring apparatus 13 on top of cap 12 in order to keep it horizontal to the ground and to make it more prominent, then cap 12 may be designed such that the child protective apparatus is activated from the top surface of cap 12.

Monitoring apparatus 13 comprises attachment means 21 to attach monitoring apparatus 13 to the top of cap 12. Attachment means 21 can be any of a number of well known attachment means (e.g. glue, tape, male or female fittings, Velcro and so forth). Attachment means 21 is not always necessary because monitoring apparatus 13 can be made as an integral part of cap 12. However, when monitoring apparatus 13 is sold separately from pharmaceutical container 11 and cap 12 then attachment means 21 is necessary. In some cases it may be desirable for attachment means 21 to also be detachable (e.g. removable tape, removable glue or Velcro) so that it can be used on multiple medical containers, one after another. In other words it may be desirable for monitoring apparatus 13 to outlast the usage on any particular medical container and be usable on other later medical containers.

Figure 2:
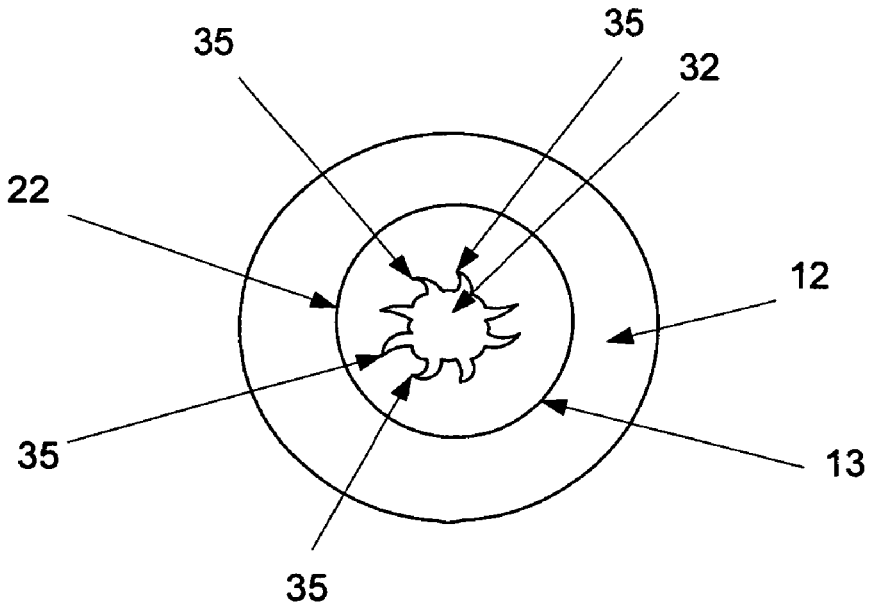
FIG. 2 is a top view of the monitoring apparatus.

In the embodiment shown in FIGS. 1-2, the monitoring apparatus comprises a base 22, a cover 26, and foam 32. The cover 26 is compressible so that foam 32 is also compressible. Under normal circumstances (i.e., when foam 32 has not been pressured), foam 32 contains an observable fluid (not expressly shown). However, when cover 26 is pressed and foam 32 (i.e., the first reservoir) comes under pressure, the observable fluid flows out of foam 32 (i.e., the first reservoir) and into the second reservoir 33 (i.e., the open space defined by cover 26, base 22, but not including foam 32). Once the pressure is relieved from foam 32 (i.e., first reservoir), it will tend to reabsorb (i.e., reverse flow) the observable fluid from second reservoir 33. By observing the change in appearance of the first reservoir and/or the second reservoir as the reverse flow occurs and by knowing the amount of time it takes for the reverse flow to occur, one can determine if foam 32 has been pressed recently. In other words, if there is observable fluid in second reservoir 33, then one knows that foam 32 was recently pressed. In one embodiment, it is important that the base 22 be non-porous so that the observable fluid (e.g., ink or dye) present inside of foam 32 will pool on top of first reservoir 22 and not be absorbed into it. This non-porous material of first reservoir 22 may be any of a number of well known materials. Base 22 is preferably smooth and non-absorbent to the ink or dye. It should also be preferably a color that is easily differentiated (i.e. contrasts) from the observable fluid. Possible materials include silicon, Mylar, PVC and any of a number of non-porous plastics or metals.

Cover 26 is designed to assure that the ink or dye in foam 32 does not either (1) escape from the indicator when it is pressed out of foam 32, or (2) get on the hands of the user of the indicator when it is activated. In order to allow foam 32 to be compressed, cover 26 must be flexible enough to allow the user to compress foam 32 by pressing down on cover 26. Finally, cover 26 also needs to be transparent so a user can see the color changes that will occur to foam 32 and base 22 when foam 32 is compressed. Cover 26 may be any of a number of well known membranes or plastic covers well known in the art similar to those used for blister packs (e.g. pre-formed plastic such as PVC).

Cover 26, base 22 and foam 32 form the boundaries of a three dimensional space which is available to accept fluids into additional reservoirs. As shown in FIGS. 1 and 2, a second reservoir 33 is present. It is understood that there might be multiple spaces or reservoirs, depending on the shape of foam 32 and cover 26. Second reservoir 33 is important because it is the area where the ink or dye from foam 32 goes when a user compresses foam 32 by pressing on cover 26 above foam 32. This pressing of foam 32 will force the ink or dye out of the foam and into second reservoir 33. As this occurs, the ink or dye will fill (or partially fill) second reservoir 33 while pooling or sitting on the surface of base 22 because it is non-porous. Since the ink or dye is designed to have an observable color this compressing of foam 32 will result in a loss of some color from foam 32 and the simultaneous coloring of second reservoir 33 (especially when compared to the normal color of base 22). As an example of how this might appear, if base 22 is white and the ink or dye is red then the change in color of second reservoir 33 will be dramatic as it goes from white to red. In some embodiments it may be desirable that second reservoir 33 is not completely open but instead contains a porous material which allows the ink or dye to be squeezed out of foam 32 but then allows foam 32 to preferentially reabsorb the ink or dye over a period of time.

When foam 32 is compressed by the user, some or most of the ink or dye will flow out of foam 32 into second reservoir 33 and onto base 22. The dye in second reservoir 33 and onto base 22 make it is obvious to an observer that at some point in the past foam 32 has been compressed. However, if the ink or dye simply remained in perpetuity in second reservoir 33 then a user would only know that at least once in the past monitoring apparatus 13 had been activated. This knowledge of one time use would not be very helpful for multiple use apparatuses. Fortunately, foams or any other absorbing materials, by their very nature, will tend to absorb liquids in contact with them. Accordingly, immediately after foam 32 is compressed and releases its ink and dye, foam 32 will begin the process of reabsorbing the same ink or dye. After a predetermined range of time after having pressure applied to the foam 32, the ink or dye that was originally in foam 32 and then forced out into second reservoir 33 will be mostly reabsorbed into foam 32. In one embodiment, the predetermined range of time is based upon a pharmaceutical attribute, such as length of time between use of a pharmaceutical container, an expiration date for medication contained in the pharmaceutical container, and the like. At this point an observer will be able to see the original color of the surface of base 22 (some portions of base 22 may remain covered with ink or dye but significant portions will be ink or dye free). By looking at the indicator and quickly noting if base 22 is covered with ink or dye, the user will be able to monitor the re-absorption of the ink or dye.

In an alternative embodiment, it may be possible to leave out base 22 and simply make cover 26 entirely surround second reservoir 33 and foam 32. In a case without base 22 the user would peer into transparent cover 26 to look for the presence or absence of the ink, dye or other fluid in second reservoir 33. In this embodiment the lower portion of cover 26 might be coated to make it a color which contrasts dramatically with the color of the ink or dye. In such an embodiment the top portion of cover 26 would necessarily remain transparent so that the user can observe the color changes.

This re-absorption process will take place over roughly the same period of time each time monitoring apparatus 13 is activated. By knowing how long the re-absorption process takes, and observing whether ink or dye remains in second reservoir 33, the user will know the minimum amount of time that has passed since they last activated monitoring apparatus 13 by pushing down on foam 32 (through cover 26). Since this likely corresponds with the last time they took their medicine, this allows them a quick visual check to see if they have used pharmaceutical container 11 over some period of time of interest to them.

By choosing different viscosities of observable fluid (e.g., ink or dye) and different characteristics of foam (e.g. different densities or cell sizes) it is possible to come up with a number of different time periods for re-absorption of the ink or dye. This allows for the design and manufacture of a number of different indicators designed to accomplish re-absorption of the observable fluid (e.g., ink or dye) over differing time periods depending on the medicine of interest. For example, for a statin which is intended to be taken only once a day, the desired re-absorption period is likely over eight to twelve hours and perhaps even more preferably sixteen to twenty-four hours. This would allow a user who has forgotten whether or not he has taken the pill to view the indicator to see if second reservoir 33 is largely clear of ink or dye. If it is largely ink or dye clear then they know that they have not activated the indicator for some long period of time and it is likely that they have not taken the pill that day. Similarly if they recently took the pill but forgot that they had taken it they could check the indicator and if second reservoir 33 has lots of ink or dye in it (i.e. the surface of base 22 is completely covered) then they will know that they've already taken the pill that day and they won't over medicate themselves by unnecessarily taking a second pill.

In another embodiment, not expressly shown, the ink or dye squeezed out of the foam may enter tubes rather than an open space as shown in FIGS. 1 and 2. The process of re-absorption would work similarly.

As a second example, for a pill intended to be taken every four hours (e.g. a pain reliever such as ibuprofen), by choosing less viscous dyes or less dense foams the indicator can be designed to reabsorb the ink or dye in a three to four hour period. Like with the statin above, this ability to know from viewing the indicator whether or not it has been activated during a minimum period of time is extremely helpful to a user. It can act as a reminder that the pill has not been taking during the period of time desired (i.e. the observable fluid is not in second reservoir 33) or that the pill has been taken in less than the minimum period of time between doses (i.e. the observable fluid has not been totally reabsorbed).

As an alternative to having different indicators for different desired times, it may be possible to have a single indicator. The single indicator might be of long duration and include with the indicator a strip showing different shades of color which correspond to different re-absorption durations. These kinds of strips have been used in the pool chemistry industry to allow users to gauge amounts of chemicals in their pool (e.g. chlorine levels). The same concept of matching colors with duration since use of the indicator may be possible in the subject invention. The differing shades of color foam 32 may be the standard for a user to view in this case as opposed to looking the coloring of second reservoir 33.

FIG. 2 shows a top view of cap 12 and monitoring apparatus 13 from FIG. 1. The purpose of FIG. 2 is to show that it might be desirable for foam 32 to have appendages 35. Appendages 35 (e.g. fingers, tentacles or peninsulas) are designed to reach out into second reservoir 33 in order to make sure that all or most of the ink or dye is able to be reabsorbed by foam 32. Appendages 35 of foam 32 may be especially desirable if monitoring apparatus 13 is not attached to a flat surface on pharmaceutical container 11 or cap 12 or if the user stores their medical containers on their sides or tilted off the horizontal plane. In these cases the ink or dye which is pushed out into second reservoir 33 may need to fight gravity in order to be reabsorbed into the foam 32. Appendages 35 will help accomplish this anti-gravity feat.

FIG. 3 shows one embodiment which does not necessarily include an absorbent material to hold the fluid. In FIG. 3, monitoring apparatus comprises observable fluid 120 (which may be a dye, ink, viscous gel or any other flowable or spreadable medium) contained between flexible membrane 110 and base 102. Membrane 110 and base 102 are normally sealed around their periphery. Base 102 may include an attachments means 101 to allow monitoring apparatus 100 to be attached to various articles such as the pill bottle of FIGS. 1-2. It may also be incorporated as an integral part of any of the various apparatuses or containers with which it may be associated (see for example the toothpaste tube of FIG. 9). In one embodiment, the first reservoir and second reservoir are indistinguishable until monitor 100 is pressured. At this time, the observable fluid flows away from the pressured area (e.g., first reservoir), and into the portion of monitor 100 not being pressured (e.g., second reservoir).

FIG. 4 shows monitoring apparatus of FIG. 3 as it is being pushed by finger 200. As shown in FIG. 4, as finger 200 presses down on membrane 110, membrane 110 depresses and pushes fluid 120 away from a first area (i.e., first reservoir) to a second area (i.e., a second reservoir or an area of less pressure). This push or pressure may be associated with an event such as the opening of a pill bottle, pharmaceutical container or toothpaste tube, or any other related event. The pressure on monitoring apparatus may also not be associated by any particular event but may be done consciously by a user wishing to know a time duration for an act unassociated with any particular apparatus. In this embodiment, monitoring apparatus may simply be placed anywhere on any surface and the timer/indicator is activated by a user remembering to activate the timer (as opposed to activation being automatic as some event occurs or upon activation of an apparatus or container). For one example, the monitoring apparatus may be placed on a dog bowl and pressed each time the animal is fed in order to allow a pet owner to monitor whether the pet was recently fed.

FIG. 5 shows monitoring apparatus 100 of FIGS. 3 and 4, a period of time after finger 200 has pressed monitoring apparatus. In order for finger 200 to be able to compress membrane 110, it is important that there be sufficient space for fluid 120 to migrate to when pressure is exerted (i.e. you can not overfill the space between first reservoir 102 and membrane 110 with fluid 120). FIG. 5 shows membrane 110 still in the compressed state and with fluid 120 still pushed away from area 150 (i.e., pressured area) where the indentation remains In at least one embodiment, there is a color difference between base 102 and fluid 120 and membrane 110 is transparent. In this instance the user will dramatically see the pressured area 150 where finger 200 has pressed down since base 102 is visible in this area surrounded by the contrasting color of fluid 120 in the remainder of monitor 100. In some embodiments it may be base 102 which is transparent and the color of flexible membrane 110 is different from fluid 120 in order to see the contrast (in some embodiments both membrane 110 and first reservoir 102 may be transparent).

In one embodiment, base 102 is less soft or pliable than membrane 110. This is so that when one presses on membrane 110, fluid 120 is forced out of the way because of the relative rigidity of base 102. Base 102 can be made of any of a large number of various materials well known in the art such as a rigid plastic (e.g. acrylics, pvc, thick polystyrene), wood, rubber, metal sheets (e.g. aluminum foil), canvas or heavy paper products such as cardboard.

Membrane 110 can also be comprised of a large number of various materials. It is important that it be less stiff than base 102; durable enough not to rupture under normal pressure; and it should be able to return roughly to its original shape after pressure is exerted upon it (e.g. have a memory). Also like base 102 it should be compatible with fluid 120 and nonporous to fluid 120.

After pressure is exerted on membrane 110 it should start to return (more or less) to its original shape and fluid 120 will flow back into the space it has been squeezed away from. This returning of membrane 110 roughly to its original shape can be caused by (1) the flow of fluid 120 back into the space it was squeezed out of by the pressure; (2) membrane 110 has a "memory" and it is predisposed to return to its original shape; or (3) a combination of (1) and (2) immediately above.

As fluid 120 returns to area 150 (i.e., the area underneath of where the pressure was exerted upon membrane 110), a color change will occur (i.e. either one begins to see the color of fluid 120 in the area or the color of base 102 will slowly disappear or some combination of the two. By carefully choosing the viscosity and characteristics of fluid 120 and the thickness, pliability, memory, tautness of membrane 110 (i.e. now tightly it is stretched across monitoring apparatus) and other membrane characteristics, one can control how long it takes for fluid 120 to return to its original position and recover the portion of base 102 that it was squeezed away from.

In another embodiment of the indicator of FIG. 3 (not expressly shown), there could be an absorbent material (similar to FIGS. 1-2) included in the area between membrane 110 and base 102 where pressure is exerted. It may also be desirable to have some type of button, piston or other device (not expressly shown) that presses upon membrane 110 rather than a finger or other body part, in order to assure that the pressure is consistently applied and that the area where fluid 120 is pressured away from is consistently the same size.

Membrane 110 can be made of numerous different substances. A few non-exhaustive examples include thermoplastic resins such as polyethylene, polyvinylchloride or copolymers of vinyl chloride and vinyl acetate. Other thermoplastic resins include polyvinyl acetate, polymethyl methacrylate, cellulose acetate butyrate, polyvinylidene chloride, polyvinyl butyral, polysulfone, and copolymers and/or combinations thereof. Any membrane (or sheet) will work so long as it is pliable enough, tough enough to resist tearing, compatible chemically with fluid 120 and will return repeatedly to roughly its original shape after pressure is exerted upon it (this return may be caused by either the memory of the material or the pressure from fluid 120 or a combination of the two). In one example, a silicone gel of 600,000 centistokes from Gelest Company was inserted between a rigid base (an SLA plastic part) and a urethane membrane 0.01 inches thick. The urethane membrane was attached to the rigid base using radio frequency sealing techniques. Using this method and varying the amount of the 600,000 centistokes silicone gel in the sealed fluid containers allowed us to vary the timing from 30 seconds to 120 seconds with some accuracy and repeatability.

The thickness of membrane 110 may be of any suitable thickness and may change dramatically depending upon the final intended use (e.g. the thickness for a vitamin bottle might differ from a dog bowl). U.S. Pat. No. 5,958,525 (incorporated herein by reference) sets forth thicknesses for the finger painting product with a range of from about 0.1 mil (0.0001 inch) to about 10 mil (0.01 inch).

An example of an apparatus where a fluid is compressed between a base and a membrane can be seen in an unrelated end use with a commercial product. Crayola (owned by Binney & Smith) has a product called Creativity Central having as a component a board for "Mess Free Finger Painting". The Crayola product allows kids to finger paint through a membrane in order not to create a mess. During an experiment with this commercial product, a user pressed their forefinger into the membrane until the background color was showing. This indentation was 1.1 centimeters in diameter. Two hours later, the indentation area (i.e. the area not covered by the blue fluid) was 0.5 cm in diameter. Six hours later the entire original indentation was covered by the blue fluid. Further, by changing the portion of the screen of the "Mess Free Finger Painting" product where a person presses with their finger, one can change the time required for an indentation to be refilled by blue fluid. In some areas of the screen the blue fluid will not refill the indentation. In others it can happen very quickly. By picking the right amount of blue fluid in an area (which relates to tautness of the cover) an experimenter can change the time required for the blue fluid to cover the indentation.

Figure 6:
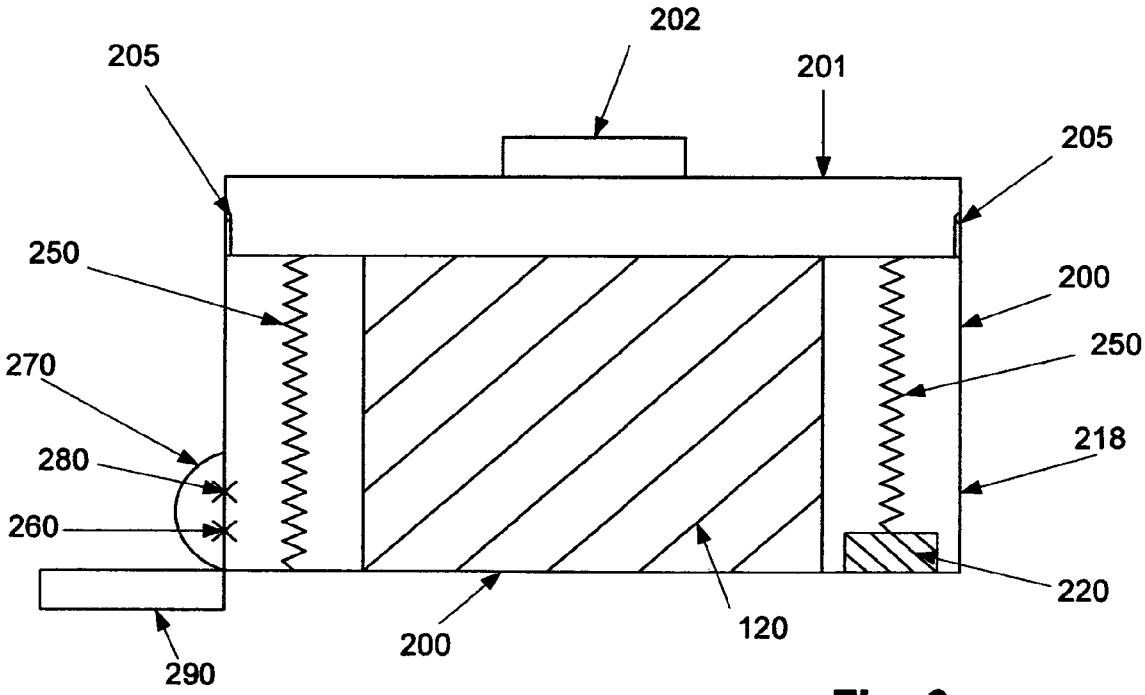
FIG. 6 is a side view of an alternate embodiment of a monitoring apparatus having a deformable absorbent material, a check valve, an elasatomeric reservoir and a second valve allowing slow return of the fluid to the absorbent material.
Figure 7:
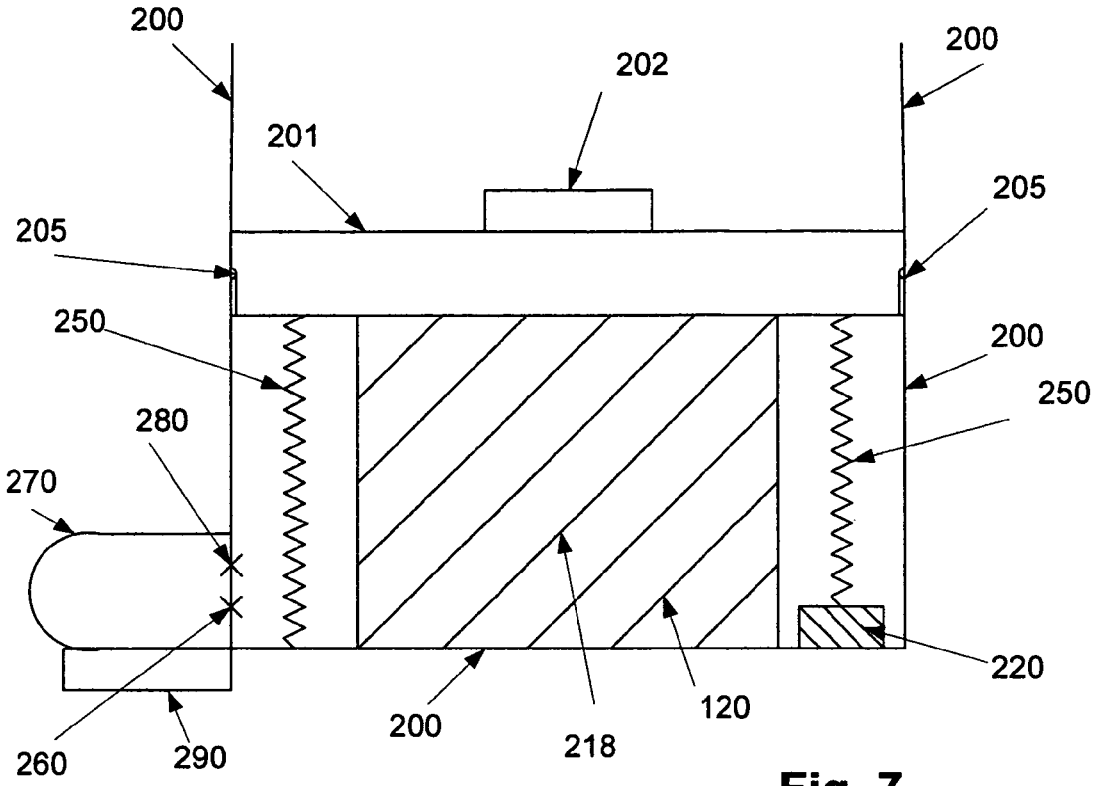
FIG. 7 is a side view of the alternate embodiment of the monitoring apparatus shown in FIG. 6 after pressure has been applied and the fluid has entered the elastomeric reservoir, and before the fluid has returned through the slow return valve to the absorbent material.

Another embodiment of the invention is shown in FIGS. 6-7. In this embodiment of the invention, fluid 120 is contained within absorbent material 218. Absorbent material 218 is housed within a first area of the indicator defined by a non-porous container 200. Container 200 is adapted to accept piston 210 when button or activator 202 is pressed. As piston 201 enters container 200 it compresses absorbent material 218 which in turn squeezes out fluid 120 (there may be fluid both inside of absorbent material 218 and also within other areas of container 200 not filled with absorbent material 218). To assure that piston 201 enters container 200 far enough to squeeze out the desired amount of fluid 120 there is pressure indicator 220. Mechanical devices which "click" or give some other tactile or audible indication when a member is fully engaged are well known in the prior art. Piston 201 of this embodiment is associated with springs 250 which serve to return piston 201 to its normal position after the piston has been fully inserted into container 200. This return of piston 201 allows absorbent material 218 to return to its normal size and shape after it has been compressed by piston 201.

As piston 201 compresses absorbent material 218 and reduces the volume available in container 200 for fluid 120 (fluid 120 can not escape around piston 201 because of O-ring 205) it is forced through check valve 260. Check value 260 is a one way valve like many well known in the prior art (e.g. umbrella check valves and so forth). It allows the flow of fluid 120 only in the direction out of container 200 and into a second area of the indicator defined by an elastomeric membrane 270. As fluid 120 flows into the balloon like container defined by elastomeric membrane 270, membrane 270 expands to accept fluid 120.

The expanded version of elastomeric membrane 270 is shown in FIG. 7. FIG. 7 also shows piston 201 before springs 250 have returned the piston to its normal, non-pressured position as shown in FIG. 6. As membrane 270 is expanded as shown in FIG. 7 it builds up a certain amount of energy (i.e. internal stresses) and membrane 270 desires to return to its non-stressed state. However, this can only happen if fluid 120 is released from membrane 270. This cannot occur through one way check valve 260 but it can occur through slow release valve 280. Slow release valve 280 can be as simple as a very small orifice (e.g. like a leak) which only allows small amounts of fluid 120 at a time to flow through back into container 200 and absorbent material 218. Since absorbent material 218 is now back into its normal shape and size it will readily absorb fluid 120 as it returns to container 200. Or it can also be any of a number of pressure relieving or slow release valves well known in the art. One example is shown in U.S. Pat. No. 6,236,624 (which is incorporated herein by reference). The '624 patent discloses a small opening filled with a porous material (e.g. a porous flit) through which fluid 120 can flow.

In another embodiment of the apparatus as shown in FIGS. 6-7 (not expressly shown) it may not be necessary to have an absorbent material within the container to be compressed by the piston. The absorbent material of FIGS. 6-7 can help the return of the fluid from the container with the elastomeric material which is stressed because the absorbent material has a natural tendency to suck up or absorb the fluid. However the internal stresses of the stressed elastomeric material may be sufficient alone to transfer all the fluid back into the original area of the indicator.

Unlike in the '624 patent which uses mechanical movements caused by the fluid flows to effect some pneumatic result (i.e. the triggering of an electrical contact) because of the movements of the two parts relative to each other, the current invention indicates the passage of time by a user visually observing the flow of fluid into and out of elastomeric membrane 270. This could be indicated by a color change of area 290 adjacent to membrane 270. For example, if area 290 is white but membrane 270 is red, a user when looking from above the indicator will note that area 290 is white before the indicator is activated (i.e. the fluid has not inflated membrane 270 and the user is viewing the white surface of area 290). However, after the indicator has been activated, membrane 270 inflates and covers white area 290. The same viewer will now see area 290 as being red (or any other color in contrast to the color of area 290). The color change can be caused either by membrane 290 being colored or membrane 290 being transparent and fluid 120 being colored. The choices of colors are not crucial but it is preferable that there be some contrast between the color of area 290 and membrane 290 or fluid 120. In another embodiment, membrane 270 may normally be hidden from view and the indication of use occurs when it expands such that a user now sees membrane 270 as it expands.

As disclosed in the '624 patent, the elastomeric material which is pressured by the fluid flow and subjected to internal pressures does not necessarily comprise a balloon like container of FIGS. 6-7. The elastomeric material may be disposed within a rigid container and the elastomeric material becomes compressed inside of this rigid container. In this embodiment (not expressly shown) the reversal of these internal stresses on the compressed material is what causes the fluid to reverse its flow through the valve leading back into the original container. There are a number of different ways for a fluid to flow quickly under pressure in one direction and then reverse its flow in another direction more slowly. Any of these modifications are intended to be covered by the claims of the subject patent.

In another embodiment, the color change is accomplished using electricity and different color lights on the indicator of the monitoring apparatus. For example, a green illuminated light on top of a pill bottle or other apparatus may mean that it is acceptable to take another pill or use the apparatus. On the other hand, a red illuminated light might mean that the pill bottle has recently been opened or activated, and the user should delay taking another pill or using the apparatus until the red light goes out and the green light becomes illuminated again. This simple, color-coded system is intuitive and very easy to understand. Most users know that red means "stop" and green signifies that it is alright to "go". It is understood that other colors may be used and it is possible that one can forego with either the red light or the green light. In an alternate embodiment using only one light, a red light could be used to indicate a user should not take another pill or use the apparatus. Similarly, the one light could be a green light indicating when it is alright for a user to take a pill or use the apparatus. In this embodiment having only one light, a test button may be included for a user to test a battery so that the user can know whether the lack of an illuminated light is due to a dead battery.

Figure 8:
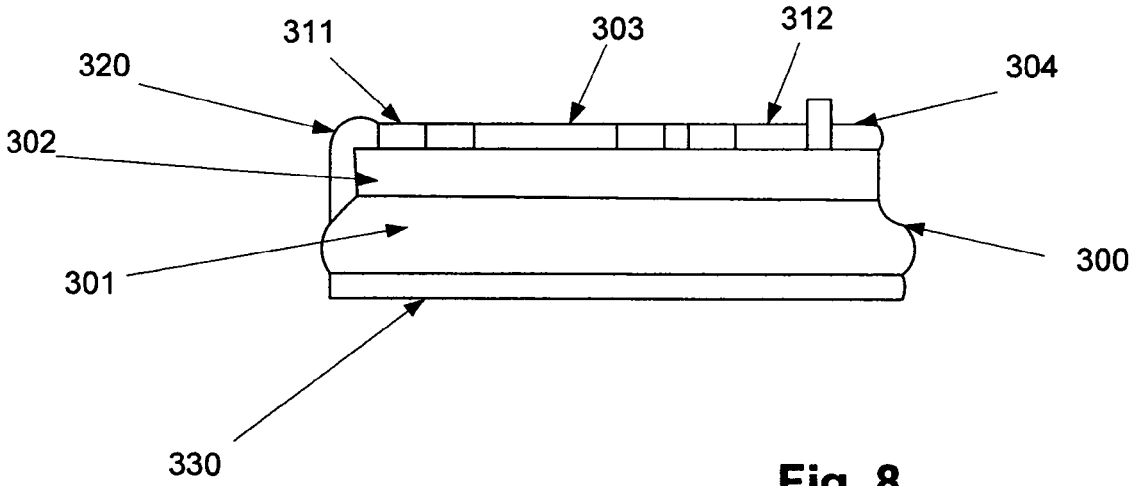
FIG. 8 is a side view of an alternate embodiment of a monitoring apparatus having electrical means for changing color lights on the monitoring apparatus.

In FIG. 8, monitoring apparatus 300 comprises battery 301 connected to printed circuit board 302, and a cover 320 over the monitoring apparatus 300. Board 302 comprises controller 303, red light 311, green light 312, and switch 304. Controller 303 controls the illumination timing of red light 311 and green light 312. The controller timing is activated by button 304, which is triggered when a user opens the pharmaceutical container, or uses some apparatus, and indicates that a pill has been taken or the apparatus used. When switch 304 is triggered, controller 303 causes red light 311 to illuminate for a period of time associated with a predetermined range of time, such as the minimum period of time necessary between dosages of the medicine. At the end of the predetermined range of time, controller 303 turns off red light 311 and begins illuminating green light 312. This signifies to the user that the pharmaceutical bottle or other apparatus is safe to use again.

Some medications have both a minimum period of time between uses and a maximum number of times per day the medication can be taken over and beyond the minimum period of time. Controller 303 can be programmed so that red light 311 stays on even after the minimum period of time has passed if the pill bottle has already been opened the maximum number of times allowable for the day. For example, if a pain medication is designed to be taken every four hours but can only be taken three times over a twenty-four hour period, the red light will stay illuminated after the third dosage within the twenty-four hour period, even after the four hour minimum period has passed after the third dosage.

Controller 303 may be permanently set to one specific minimum period of time, i.e. the time in which red light 311 is illuminated. This non-programmable use of monitoring apparatus 300 may be used when the monitoring apparatus 300 is only used with one type of medication or apparatus. In such a case, the monitoring apparatus 300 can become an integral part of the pharmaceutical bottle cap or bottle. In other cases, monitoring apparatus 300 may be used with multiple various medications or apparatuses. In one embodiment described herein, the monitoring apparatus 300 is likely to have releasable attachment means 330 so that the monitoring apparatus 300 can be taken on and off of different pharmaceutical containers or other apparatuses. When monitoring apparatus 300 is usable in different situations, it may be desirable for controller 303 to be programmed to different minimum times, such as four hours for a pain reducing medication, or eighteen to twenty-four hours for a statin. This programming of controller 303 can be accomplished by including small buttons or other activators (not expressly shown) on either board 302 or controller 303, which can be pushed and can change the timing of lights 311 and 312.

Figure 9:
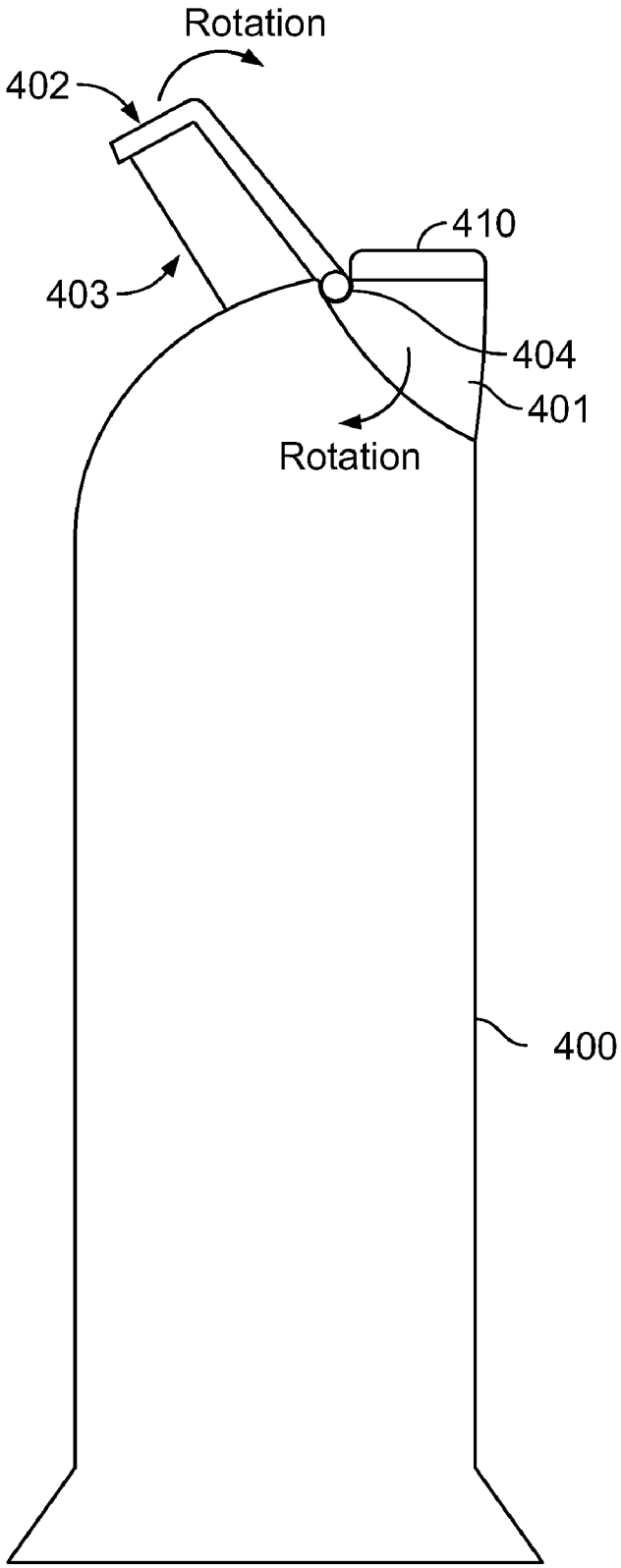
FIG. 9 is a side view of the monitoring embodiment shown in FIGS. 3-5, attached to the pump mechanism of an upright toothpaste tube.

FIG. 9 shows an embodiment of the invention where the indicators set forth in FIGS. 3-5 are an integral part of a stand up toothpaste tube. In FIG. 9, stand up toothpaste tube 400 sets upright on a surface. An example of such a stand up toothpaste tube that is commercially available is Aquafresh from GlaxoSmithKline. A user puts toothpaste on their toothbrush by pushing down on button 401. This pressure on button 401 forces closure means 402 to rotate clockwise (as shown in FIG. 9) around pivot point 404. As closure means 402 rotates clockwise this action opens up the end of nozzle 403 and toothpaste flows from the end of nozzle 403 onto the user's toothbrush.

FIG. 9 further shows timing indicator 410 attached to (or integral with) button 401. In FIG. 9, timing indicator 410 is of the type set forth in FIGS. 3-5, wherein the pressure of a user's finger causes the elastomeric cover to depress and move a viscous fluid away from where the finger pressed down and thus cause a color change as described above. Other embodiments of the reverse fluid flow timer are also possible to use on toothpaste tube 400. In the case of a toothpaste tube, it may be preferable for the color change to reverse itself after approximately 2 minutes (i.e. the desired tooth brushing time). Such an embedded timer in a toothpaste tube would be highly desirable as it may teach people how long to brush their teeth (studies show that most people brush less than half the suggested time). It would also minimize the need for much more expensive timing toothbrushes.

Figure 10A:
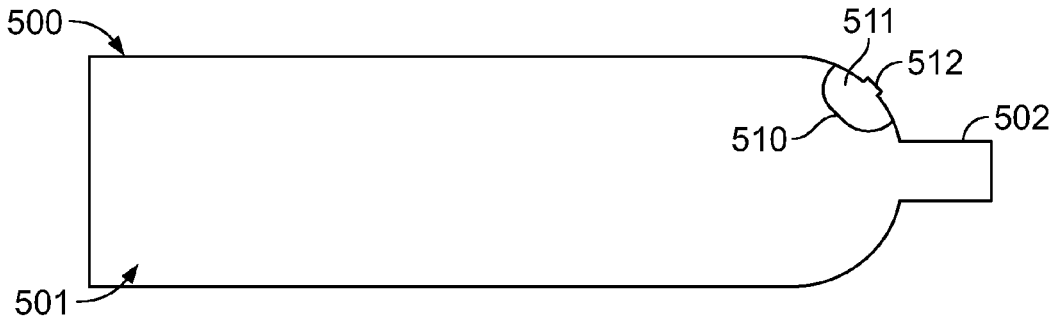
FIGS. 10*a* and 10*b* show a side cut away view of a horizontal squeeze type toothpaste having one embodiment of a monitoring/timing device of the subject invention.
Figure 10B:
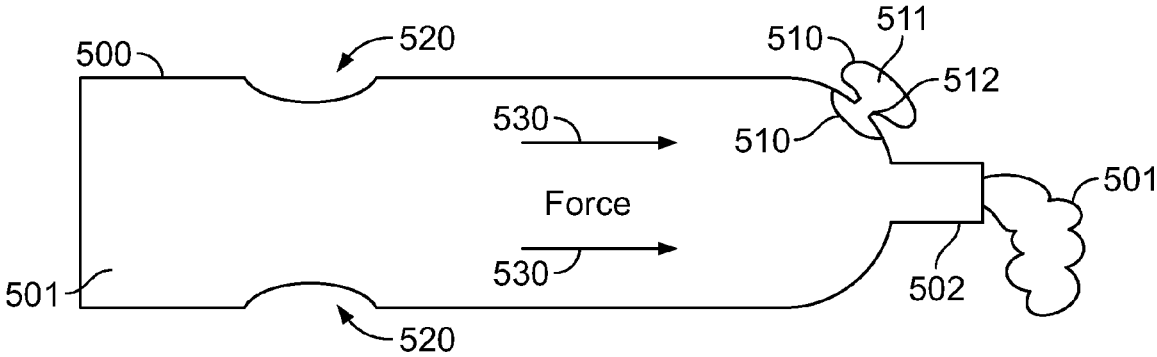

FIG. 10*a* and FIG. 10*b* show another embodiment of a reverse fluid flow timer. In this particular embodiment, as an elastomer containing a fluid is subjected to pressure it changes shape, size or location. When the pressure is removed the elastomer returns to its previous shape, size or location, over some known period of time. By observing the shape, size or location of the elastomer a user can determine the time range from an event when the elastomer was under pressure (e.g. squeezed).

In the embodiment of FIGS. 10*a* and 10*b* the reverse fluid flow timer is part of horizontal toothpaste tube 500 containing toothpaste 501. This type of horizontal squeeze toothpaste tube is well known in the art and can be found on commercially available products such as Aquafresh, Colgate and Crest. In FIG. 10*a*, tube 500 includes nozzle 502 where paste 501 exits when under pressure. Tube 500 also includes elastomeric container 510 on the inside of tube 500. Elastomeric container 510 contains fluid 511. Tube 500 further has pressure relief mechanism 512 adjacent to elastomeric container 510 (pressure relief mechanism 512 can be as simple as a small opening in tube 500 or as complex as a more involved valve mechanism). When tube 500 is not under pressure, container 510 has a certain size and shape that may or may not be visible from the outside of tube 500.

As shown in FIG. 10*b*, when tube 500 is compressed (e.g. pressured or squeezed) as shown by indentations 520, forces 530 flow through paste 501 toward exit 502 and this forces past 501 out of tube 500. Forces 530 also impact elastomeric container 510 which then puts pressure on fluid 511. As fluid 511 is pressured it flows out of pressure relief mechanism 512 and elastomeric container bulges or flows outside of tube 500. As pressure inside of tube 500 is relieved (i.e. by fluid 501 flowing out of exit 502 and by the cessation of the squeezing of tube 500), the relief of the pressure on the inside portion of elastomeric container 510 causes fluid 511 to reverse direction and the shape and/or size of container 510 changes.

By optimizing the viscosity of fluid 511 and the memory of elastomeric container 510, one can design the reversal of the flow of fluid 511 to occur over some known time range. In the case of a toothpaste tube, it may be desirable for the bulge or flow of elastomeric container 510 to happen quickly as tube 500 is squeezed but then to return to its original size, shape and location over roughly 2-2.5 minutes (i.e. the amount of brush time recommended). In this particular embodiment, a user would brush until elastomeric container 510 had receded back to its original shape and location (i.e. as shown in FIG. 10*a*). In addition to the size, shape and/or location of elastomeric container 510, one can also use color to help highlight the changes that occur to elastomeric container 510 as it is pressured and then the pressure is relieved. This can be done by either coloring the elastomer in contrast to the color of tube 500 or alternatively, keeping elastomer 510 transparent but coloring fluid 511 to some color in contrast to the color of tube 500.

In another embodiment using a horizontal squeeze tube of toothpaste such as the one shown in FIGS. 10*a* and 10*b*, it is possible to simply attach one of the indicators set forth in FIGS. 3-5 somewhere on the surface of tube 500 (not expressly shown). In this case the user would have to remember to push the timing indicator since squeezable tubes can be squeezed at many different areas of the tube.

Figure 11:
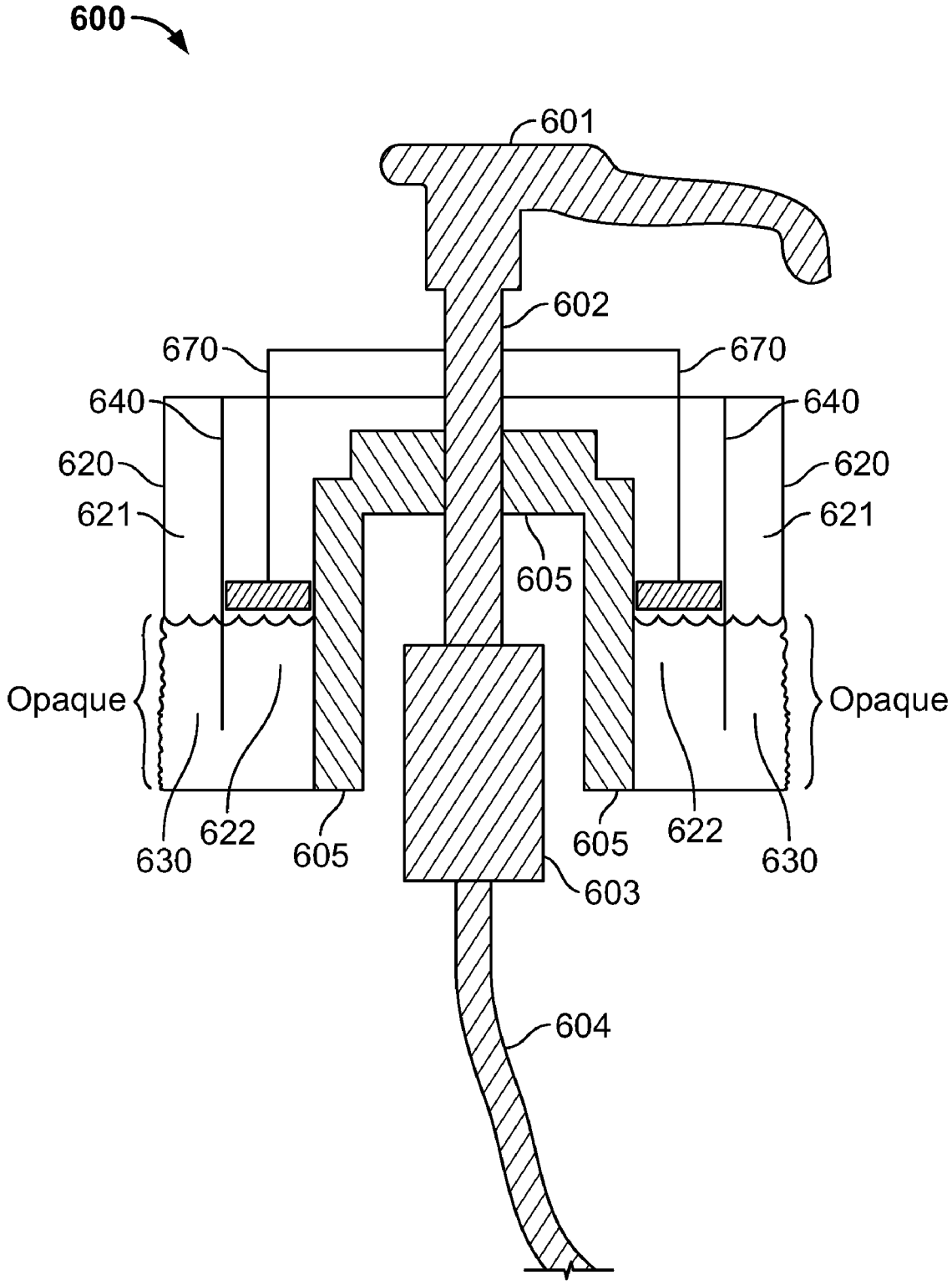
FIG. 11 shows a side cut away view of a standard fluid pump with an associated cap that includes an apparatus using reverse fluid flow when the pump is pushed down.

Another embodiment of the invention, shown in FIG. 11, uses a standard fluid pump such as those found on standard liquid soap bottles (e.g. SoftSoap), shampoo (e.g. Pert), conditioners and almost any liquid product that can be pumped. (This embodiment is also usable on foaming fluid pumps such as those on products such as Kandoo). FIG. 11 shows a standard push fluid pump 600 which includes pump head 601 which is attached to bottle plunger 602, standard valve chamber 603 (which contains the springs, diaphragms, O-rings and other components well known in the prior but not expressly shown here) and siphon 604. Standard fluid pump also includes cap 605 that is attached to the bottle (the bottle is not shown in this drawing).

FIG. 11 shows that cap 605 is surrounded by chamber 620 which holds cap fluid 630. In some embodiments chamber 620 can be an integral part of cap 650. Chamber 620 is divided into two compartments (inside compartment 622 and outside compartment 621) by partition 640. The compartments do not necessarily surround the entire 360 degrees of cap 650 and in some embodiments might just include a partial slice of the cap circumference (just for example two 90 degrees slices on opposing sides of cap 650). Inside compartment 622 is in fluid communication with outside compartment 621 because partition 640 does not reach all the way to the bottom of chamber 620 or alternatively because partition 640 has openings in it which allow fluid movement between the compartments. Accordingly, when cap fluid 630 is in a state of equilibrium the fluid levels are the same in both inside compartment 621 and outside compartment 622.

Attached to bottle plunger 602 is a second plunger that is called cap plunger 670. Cap plunger 670 moves up and down with bottle plunger 602 as pump head 601 is pushed. Cap plunger 670 enters chamber 620 and slides down inside compartment 622. This downward motion of cap plunger 670 forces some portion of cap fluid 630 which is inside compartment 622 to be pushed down toward the bottom of inside compartment 622. This portion of cap fluid 630 then flows underneath of partition 640 into outside compartment 621. This causes the cap fluid level in outside compartment 621 to rise. If the exterior walls of chamber 620 are transparent and if cap fluid 630 is colored then the additional fluid in outside chamber 621 will be able to be seen and monitored.

With a standard fluid pump such as shown in FIG. 11, after a user presses down on pump head 601, valve chamber 603 (usually having a spring) causes plunger 601 and pump head 601 to return to their normal elevated position. As plunger 602 moves upward this causes cap plunger 670 to simultaneously also begin rising out of inside chamber 622. The fluid flows accordingly (caused by the vacuum and/or gravity). The rate of the fall of the fluid in outside chamber 621 and the corresponding rise in inside chamber 622 can be regulated by things such as the viscosity of the fluid and the size of the openings in partition 640. Also the rate of the rise and fall of the fluid in the inside and outside chambers can be fine tuned by changing the relative volumes of the two chambers vis-à-vis each other. With cap plunger 670 back in its normal position, fluid 630 will begin flowing back toward its equilibrium state where the fluid levels in both inside chamber 622 and outside chamber 621 are equal. It is also possible to have some type of flotation material sitting on top of fluid 630 (not expressly shown) that makes the fluid level either more noticeable or more fun for a user (e.g. a cartoon character or some other fanciful floating unit).

By designing the size and shape of outside chamber 621 compared to inside chamber 621 and matching these physical characteristics with a viscosity of cap fluid 630, it is possible to fine tune the amount of time that it takes cap fluid 630 to drain back or be pulled by vacuum back into inside chamber 622. Further if one knows the time it takes for cap fluid 630 to reach level equilibrium a user will know how long it has been since they have pushed pump head 601. As an example of how this might be used, on a liquid soap dispenser, if it takes 20 seconds for cap fluid 630 to reach level equilibrium then a user will know how long to wash their hands once the fluid has reached level equilibrium. Further, in order to avoid confusion the bottom portion of chamber 620 might be opaque such that cap fluid 630 is not visible when in level equilibrium. In such a case one could tell a user to keep washing their hands until they no longer see any signs of cap fluid 630. Alternatively, the top portion of chamber 620 might be opaque and the bottom portion transparent so that when the fluid begins falling by gravity or being pulled by vacuum back into the bottom portion this filling up of the bottom portion of chamber 620 is what is used to tell the elapsed time. Finally it may be possible to have level marks on the transparent outside wall of chamber 620 which also will tell a user approximate intermittent elapsed times.

Further modifications and alternative embodiments of the techniques described herein will be apparent to those skilled in the art in view of this description. It will be recognized, therefore, that the techniques described herein are not limited by these example arrangements. Accordingly, this description is to be construed as illustrative only and is for the purpose of teaching those skilled in the art the manner of carrying out the techniques described herein. It is to be understood that the forms of the techniques described herein shown and described are to be taken as the presently preferred embodiments. Various changes may be made in the implementations and architectures. For example, equivalent elements may be substituted for those illustrated and described herein and certain features of the techniques described herein may be utilized independently of the use of other features, all as would be apparent to one skilled in the art after having the benefit of this description of the techniques described herein.

What is claimed is:

1. A timing apparatus on a container having a pump activated by a user pushing the pump, comprising a colored fluid;

a fluid chamber holding said colored fluid with a first compartment and a second compartment, said compartments being in fluid communication with each other and at least one of said compartments having a transparent section;

a means for moving the colored fluid from the first compartment to the second compartment when the pump is pushed; and wherein the colored fluid returns to the first compartment over some known range of time when the pump is no longer being pushed.

2. The timing apparatus of claim 1, wherein the pump is attached to the container using a cap and the timing apparatus is attached to or an integral part of the cap.

3. The timing apparatus of claim 2, wherein the cap is circular and the transparent section extends 360 degrees around the cap.

4. The timing apparatus of claim 2, wherein the cap is circular and the transparent section is a partial slice of the cap circumference.

5. The timing apparatus of claim 1, wherein the timing apparatus is attached to or an integral part of the pump.

6. The timing apparatus of claim 1, wherein the pump has a standard plunger and attached to said standard plunger is a secondary plunger that provides the means for moving the colored fluid from the first compartment to the second compartment.

7. The timing apparatus of claim 1, wherein there is an opaque section of the fluid chamber below the transparent section.

* * * * *